US010246853B2

(12) United States Patent
Huissoon

(10) Patent No.: US 10,246,853 B2
(45) Date of Patent: Apr. 2, 2019

(54) MOBILE APPARATUS WITH OPERATING SYSTEM

(71) Applicant: Hudson Bay Holding B.V., 's-Heer Arendskerke (NL)

(72) Inventor: Leendert Wilhelmus Cornelis Huissoon, Kruiningen (NL)

(73) Assignee: Hudson Bay Holding B.V., 'S-Heer Arendskerke ( * ) Notice: Subject to any disclaimer, the term of this patent is extended or adjusted under 35 U.S.C. 154(b) by 321 days.

(21) Appl. No.: 14/782,924

(22) PCT Filed: Mar. 27, 2014

(86) PCT No.: PCT/NL2014/050189

§ 371 (c)(1),
(2) Date: Oct. 7, 2015

(87) PCT Pub. No.: WO2014/168469

PCT Pub. Date: Oct. 16, 2014

(65) Prior Publication Data

US 2016/0040393 A1 Feb. 11, 2016

(30) Foreign Application Priority Data

Apr. 12, 2013 (NL) ..... 1040157

(51) Int. Cl.

| | |
|---|---|
| ***E02F 9/20*** | (2006.01) |
| ***E02F 3/96*** | (2006.01) |
| ***E02F 9/12*** | (2006.01) |

(52) U.S. Cl.

CPC ..... *E02F 9/2058* (2013.01); *E02F 3/964* (2013.01); *E02F 9/123* (2013.01)

(58) Field of Classification Search

CPC . E02F 3/325; E02F 3/301; E02F 3/302; E02F 3/306; E02F 3/384; E02F 3/96;

(Continued)

(56) References Cited

U.S. PATENT DOCUMENTS 5,739,592 A * 4/1998 Rigsby ..... B60D 1/62 280/422
6,363,173 B1 * 3/2002 Stentz ..... E02F 9/2045 382/153

(Continued)

FOREIGN PATENT DOCUMENTS

| | | | |
|---|---|---|---|
| CN | 1556888 | 12/2004 | |
| CN | 200974980 | 11/2007 | |
| DE | 19956402 | 5/2001 | |
| DE | 19956402 A1 * | 5/2001 | ..... B60K 17/10 |

*Primary Examiner* — Saul Rodriguez
*Assistant Examiner* — Brendan P Tighe
(74) *Attorney, Agent, or Firm* — Marcus C. Dawes; Daniel L. Dawes

(57) ABSTRACT

Mobile apparatus comprising a main frame (2), a sub-frame (1) connected rotatably to the main frame and an operating arm connected to the sub-frame, wherein the sub-frame is provided with a seating or standing location for a driver, operating instruments (4) controllable by a driver, and a bus system (5) connected to the operating instruments; wherein the main frame is provided with a lifting device (8) to which an implement (18) is connectable; wherein the mobile apparatus further comprises a drive (7, 17) for driving the lifting device and/or the implement, and a control unit (6, 16) connected to the bus system for controlling the drive on the basis of signals from the bus system; this such that the lifting device and/or the implement are controllable via the bus system using the operating instruments in the sub-frame.

18 Claims, 17 Drawing Sheets

(58) Field of Classification Search
CPC . E02F 3/961; E02F 3/963; E02F 3/964; E02F 9/0808; E02F 9/085; E02F 9/123; E02F 9/2058
USPC ..... 180/89.12, 89.13; 414/687, 694, 722, 414/912; 701/50
See application file for complete search history.

(56) References Cited

U.S. PATENT DOCUMENTS

| | | | | |
|---|---|---|---|---|
| 6,788,195 | B1 * | 9/2004 | Stegman | B60Q 11/005 307/10.8 |
| 2003/0137398 | A1 * | 7/2003 | Shibata | B60R 25/04 340/5.61 |
| 2003/0147727 | A1 * | 8/2003 | Fujishima | E02F 3/435 414/200 |
| 2004/0211098 | A1 * | 10/2004 | Cooper | E02F 3/964 37/352 |
| 2004/0249537 | A1 * | 12/2004 | Legner | E02F 9/0866 701/50 |
| 2009/0216412 | A1 * | 8/2009 | Mindeman | E02F 3/3695 701/50 |
| 2011/0176899 | A1 * | 7/2011 | Huissoon | E02F 3/301 414/687 |
| 2013/0133319 | A1 * | 5/2013 | Lacher | E02F 9/2253 60/327 |
| 2015/0322649 | A1 * | 11/2015 | Fleischmann | A01G 23/00 701/50 |

* cited by examiner

MOBILE APPARATUS WITH OPERATING SYSTEM

FIELD OF THE INVENTION

The present invention relates to the field of mobile apparatuses, for instance tractors, excavators, wheel loaders, arm mowers and rotating telescopic cranes, or combinations thereof.

BACKGROUND

Excavators with a main frame and a rotatable sub-frame and telescopic cranes on a rotatable sub-frame are known. In such apparatuses the motor for the drive can be provided in the main frame or in the rotatable sub-frame, wherein an electronic signal is coupled, optionally via an electronic bus system, between the main frame and the rotatable sub-frame. Further known are platforms, such as a tractor with a crane constructed thereon, wherein an operating arm can rotate relative to the fixed main frame without the cab co-rotating. Such platforms can be provided with a lifting device on one or more sides of the main frame in order to couple implements. The lifting devices are often of the three-point lift type, generally with a power takeoff shaft. These machines have neither a rotatable sub-frame nor an operating arm which co-rotates on the sub-frame.

Electronic bus systems through which digital information is transported are generally known. In vehicles these are often CAN bus systems. There are different types of bus system, such as the CANopen and the J1939 standard. ISOBUS is for instance a standardized system for communication and data exchange between tractor and implement.

Another apparatus is a combination of a main frame with lifting device and a rotatable sub-frame with operating arm as described in NL 1035694 in the name of applicant. Yet another mobile apparatus with an adjustable control pattern of an articulated arm and a single operating arm is described in NL 1027370 in the name of applicant.

SUMMARY OF THE INVENTION

Advantageous embodiments of the invention are described in the appended claims.

Embodiments of the present invention have the object of providing an improved mobile apparatus with a main frame with tyres or caterpillar tracks on which are provided one or more lifting devices for coupling implements or a stabilizing device; and with a rotatable sub-frame with one or more operating arms thereon. The invention relates more particularly to an improved electronic control system with which information can be transferred between components in the main frame and components in the rotatable sub-frame.

This object is achieved with the embodiment of claim 1.

Embodiments of the invention are based on the transfer of electronic information or digital signals between components in the main frame and in the rotatable sub-frame, so that the technical installations such as mechanisms, hydraulics, pneumatics and main electric current can take a simpler form in that these components are provided with control signals electronically or via a bus system. Sensor modules can further be coupled to the bus system, wherein the values measured by the sensor modules can be fed back via the bus system to the control units which can take account of these fed back values in operating the drive of the lifting device, operating arm and the like. In the present prior art these technical components are still usually driven hydraulically or mechanically, while the lights are typically driven electrically. These are separate hydraulic or electric flows which are centrally controlled via the bus system and one or more control units. According to a typical embodiment, the bus system is configured to communicate by means of a Controller Area Network (CAN) protocol, and for instance a CANopen system or a J1939 system, or an ISOBUS system.

Embodiments of the invention make it possible to operate a large number of functions (lifting device, operating arm and so on) of the main frame from the rotatable sub-frame, wherein a feedback of the functions operated by the driver to the driver is possible using sensors in the main frame, and particularly sensors associated with the lifting device and an implement on the lifting device.

Embodiments of the invention have the great advantage that a bus system can control a large number of functions of the whole mobile vehicle, i.e. a central control of the operating arm on the rotating sub-frame as well as the one or more lifting devices on the main frame, and can here also distribute the motor power and/or the energy flows between the operating arm, the implements on the lifting arm and the one or more implements on the lifting devices on the main frame. A further innovative aspect is that the bus system controls the energy supply from the rotatable sub-frame to the implements coupled to the main frame.

According to yet another aspect of the invention, the mobile apparatus is configured to operate the movement of the lifting devices and the control of the one or more implements on the lifting devices on the main frame via a driver-operated remote control outside the mobile apparatus. The mobile apparatus comprises for this purpose a receiving device for receiving control signals from the remote control and for transmitting the control signals via the bus system to the control unit of the drive of the lifting device and/or the implement coupled thereto.

According to yet another aspect of the invention, additional operating instruments are provided on the main frame which communicate via the bus system with main control components in the rotatable sub-frame and, via the computing unit or computer in the sub-frame, operate the one or more lifting devices and implements therein.

According to an embodiment, a mobile apparatus has a main frame with tyres or caterpillar tracks having thereon one or more lifting devices to which can be coupled implements such as a wood chipper, a ground cutter, a salt-spreader, a grass mower, a pallet fork, a stabilizer shield. Many other implements for forestry or agriculture, construction or for landscape management can be coupled via a lifting device to the front or rear side of the main frame. The type of lifting device for coupling an implement can be random, for instance a known three-point lifting device. A rotatable sub-frame with a workplace or cab for the driver and one or more operating arms is arranged on top of the main frame, usually via a vertical or substantially vertical shaft. Via operating instruments on the rotatable sub-frame and via the bus system the driver can control the energy for operating the implement on a lifting device or moving a lifting device itself on the main frame.

This energy can be mechanical, hydraulic, pneumatic, electrical or a combination.

The skilled person will appreciate that an operating instrument on the sub-frame can be a computer or a panel with a number of buttons, or can be one or more joysticks or a combination thereof which transmits the commands entered by the driver, optionally via a computing unit/computer, to the bus system in the form of suitable signals.

Control units which transmit the different bus signals/commands from the bus system to the drive of for instance a lifting device or an implement on the lifting device are for instance so-called controllers or I/O units or interfaces or ECUs, which control the mechanical, hydraulic, electrical, pneumatic energy flows or combinations thereof on the basis of the bus signals. One of the examples is that such a controller operates an electric relay or a hydraulic valve. An electrical energy flow comes from for instance a battery or a generator. A hydraulic energy flow comes from for instance a hydraulic pump. A pneumatic energy flow comes from for instance a compressor. A mechanical energy flow comes from for instance a rotating shaft. These possible media, and thus energy flows, provide for movement of a lifting device or an implement, or a part of an implement on a lifting device.

According to an embodiment, the control unit (for instance a controller or I/O unit) of the lifting device can be placed in the rotatable sub-frame, although it is also possible for this control unit to be placed in the main frame.

According to different embodiments, the control unit (for instance a controller or I/O unit) of the drive of an implement on a lifting device can be placed in the rotatable sub-frame, although it is also possible for this control unit to be placed in the main frame.

According to different embodiments, the sub-frame can rotate partially or through 360 degrees.

According to different embodiments, the bus signals can be transmitted between the rotatable sub-frame and the main frame and vice versa by a so-called slip ring, or even via a wireless communication means.

According to a possible embodiment, the lifting device is provided with a quick change system for coupling an implement to the lifting device. The quick change system can have a geometry similar to that of a quick change system of an excavator or loading shovel, for instance of the Lehnhoff type (patent DE 102006023420), the OilQuick type, the Verachtert type or the Gangl or Gangl Docking Systems type. The quick change system is preferably adjustable using positioning means. A quick change control unit connected to the bus system can be provided here which is configured to control the positioning means on the basis of signals from the bus system.

According to a possible embodiment, wherein the control units are placed in the main frame, they receive and transmit bus signals from and to the corresponding bus system in the rotatable sub-frame.

A further embodiment provides for transfer of the bus signals between main frame and sub-frame via a so-called slip ring.

A further embodiment provides for transfer of the bus signals between main frame and sub-frame via a contactless wireless connection, such as for instance radiographically or via Bluetooth. A slip ring is an electromechanical device able to transmit power or electrical signals from a stationary structure to a structure freely rotatable through 360 degrees.

A further embodiment provides additional operating instruments which are placed at a location on the main frame and can be operated by the driver. The operating instruments transmit a bus signal, for instance for operation of a lifting device or the rotation of a power takeoff shaft in the vicinity of the lifting device, or operation or control of the implement in the lifting device itself. The location where the operating instruments are placed can be in the vicinity of the lifting device, such as for instance on a wing of a wheel or caterpillar track.

According to yet another embodiment, a control unit connected to the bus system is provided for controlling the energy source for the purpose of moving the mobile apparatus, such as for instance a diesel engine, a petrol engine, a gas motor, an electric motor, a battery pack or other type of motor or energy source in the rotatable sub-frame or in the main frame.

An embodiment is possible wherein the driver enters commands via a remote control system, wherein these are transferred via an antenna and data transmitter to the bus system for the purpose of controlling the mobile apparatus, and particularly the lifting device or the implement in a lifting device. The antenna or data transmitter can be placed here in the sub-frame or in the main frame.

A further embodiment provides for control of a plurality of energy flows to an implement in the lifting device. A first energy flow can for instance thus control the drive of the implement and another energy flow can control the adjustment of the implement or a part of the operation of the implement. The energy flows can be hydraulic, mechanical, electrical, pneumatic or of other type.

A further embodiment provides for control of a plurality of energy flows to an implement in the lifting device. A first energy flow can thus provide for driving of the implement and another flow for the adjustment of the implement or a part of the operation of the implement. The energy flows can be hydraulic, mechanical, electrical, pneumatic or of other type. An energy flow is for instance a rotating shaft, known as a power takeoff shaft, in the vicinity of the lifting device. The adjustment of the implement can also be realized via a hydraulic coupling.

A further embodiment provides for control of a plurality of energy flows to a lifting device. A first energy flow can thus provide for moving the lifting device up and downward and another flow of energy can provide for the adjustment of the angle of the lifting device, such as for instance adjustment of the angle of a three-point lifting device or the angle of a quick change system on the lifting device of the types as described above.

A further embodiment has sensors coupled to the bus system which provide information about a lifting device or about an implement in the lifting device, or about a trailer being drawn beside a lifting device. In this latter case one or more sensors coupled to the bus system provide information about the state of the drawn trailer to the driver in that a bus signal reaches the operating instruments in the rotating sub-frame. Warnings in respect of implements or drawn trailers are then transferred via the bus signal. Examples of signals are for instance the state of the lights of a trailer or the state of the braking device of a trailer.

A further embodiment makes it possible to use sensors in the sub-frame as input in combination with sensors in the main frame. The signals can be transmitted via the bus system to a computing unit connected to warning means so that warnings or modifications in the control of the mobile apparatus can be communicated to a driver. An example is an input for the rotation angle of the sub-frame, an input for the position of the operating arm on the sub-frame and an input for the position of the lifting device.

A further embodiment makes it possible, via the bus system, to control lighting units such as rear lights and brake lights of a drawn trailer or implement coupled to the main frame, while the energy supply for the lighting comes from another electric source.

A further embodiment has an operating arm on the sub-frame in the form of an articulated arm which can be folded from an articulated position to a position in which the arm functions as a single lifting arm. This short lifting arm can move at a very short distance from a lifting device on the main frame.

A further embodiment makes it possible for a driver to enter a power priority via the operating instruments. Priority can for instance be given to the travel speed or the travel power of the whole mobile apparatus, or to the implement in a lifting device on the main frame, or to an implement on the operating arm. The computing unit is then preferably configured to transmit priority signals to the different components via the bus system.

A further embodiment provides for the transfer of information via the bus system from the fixed computing unit or computer or from an additional computing unit such as for instance a mobile computer, notebook, tablet computer such as an Apple iPad or Samsung Tab, to a control unit of an implement in a lifting device. A salt-spreader on the main frame can thus be controlled for instance via the bus system on the basis of GPS information available in a computer in the sub-frame.

A further embodiment provides for operation of a lifting device via the operating instruments in the sub-frame and via the bus system. The lifting device can thus be pushed downward or moved upward, or even have a floating function. Floating means that an implement in the lifting device can follow the ground during travel of the mobile apparatus. The control unit of the drive of the lifting device is then placed on the main frame or can be placed on the lifting device itself.

The above stated and other advantageous features and objects of the invention will become more apparent, and the invention better understood, on the basis of the following detailed description when read in combination with the accompanying drawings, in which.

Figure 1A:
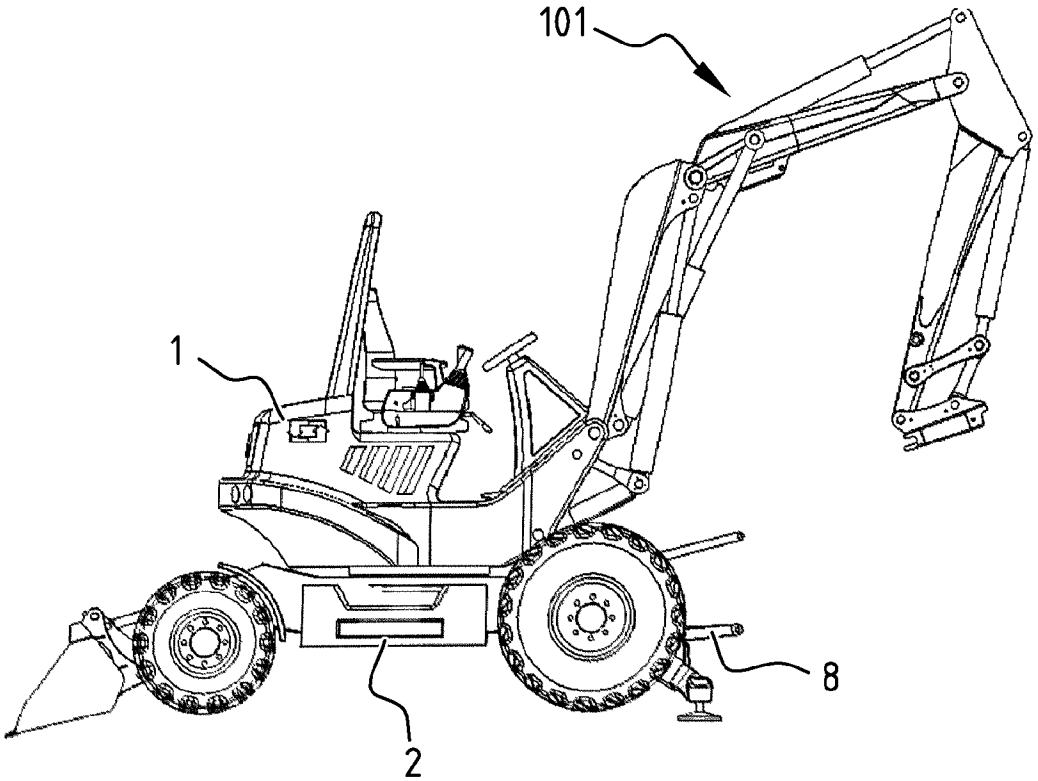
FIG. 1A illustrates a schematic side view of a first embodiment of a mobile apparatus.
Figure 1B:
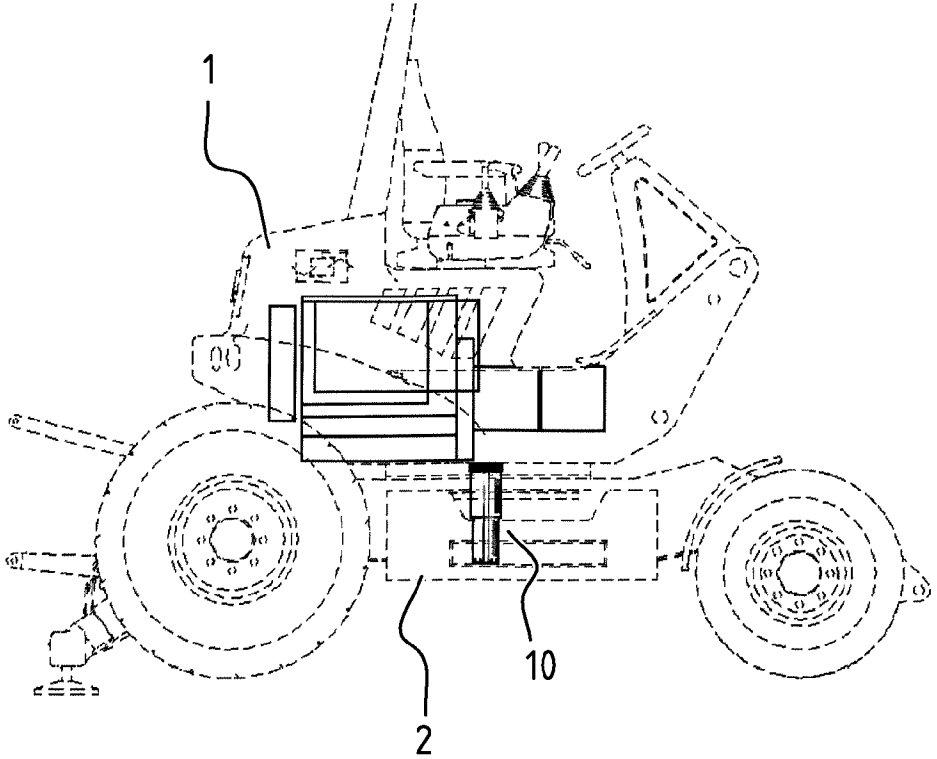
FIG. 1B illustrates a schematic side view of a second embodiment of a mobile apparatus.
Figure 1C:
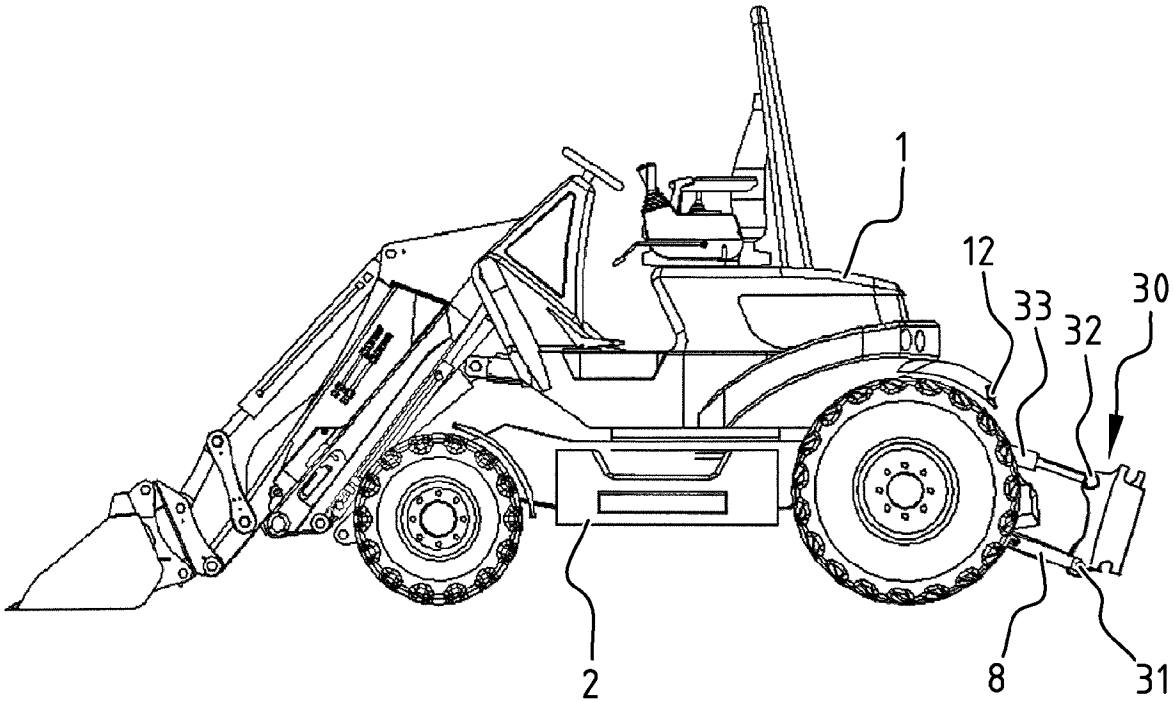
FIG. 1C illustrates a schematic side view of a third embodiment of a mobile apparatus.
Figure 1D:
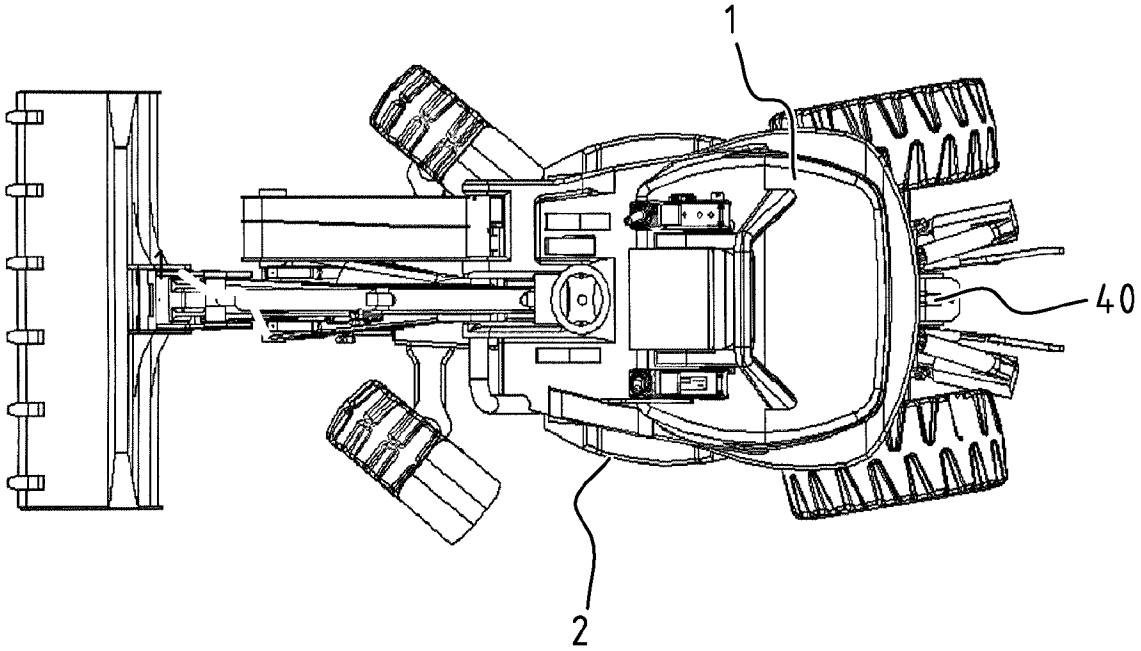
FIG. 1D illustrates a schematic top view of a fourth embodiment of a mobile apparatus.

FIG. 1A shows a first embodiment of a mobile apparatus with a main frame 2 and a rotatable sub-frame 1 arranged thereon. An operating arm 101 is arranged on sub-frame 1. Provided on the main frame is a lifting device 8, for instance a three-point lifting device. FIG. 1B shows a second embodiment of a mobile apparatus with a main frame 2 and a rotatable sub-frame 1 arranged thereon, wherein a slip ring 10 is arranged between sub-frame 1 and main frame 2 for the purpose of throughfeed of a bus system from sub-frame 1 to main frame 2, see also FIG. 7. FIG. 1C shows a third embodiment of a mobile apparatus with a main frame 2 and a rotatable sub-frame 1 arranged thereon, wherein a lifting device 8 with quick change system 30 is provided on main frame 2. Quick change system 30 is connected via rotation points 31, 32 to respectively lifting device 8 and a cylinder (positioning means) 33 for the purpose of positioning quick change system 30. Such a positioning means will allow the quick change system to be placed in a suitable position for coupling to an implement. Operating instruments 12 are further provided on main frame 2. FIG. 1D shows a fourth embodiment of a mobile apparatus with a main frame 2 and a rotatable sub-frame 1 arranged thereon, wherein the main frame is provided with a power takeoff shaft 40 which can function as mechanical drive for an implement.

Figure 2:
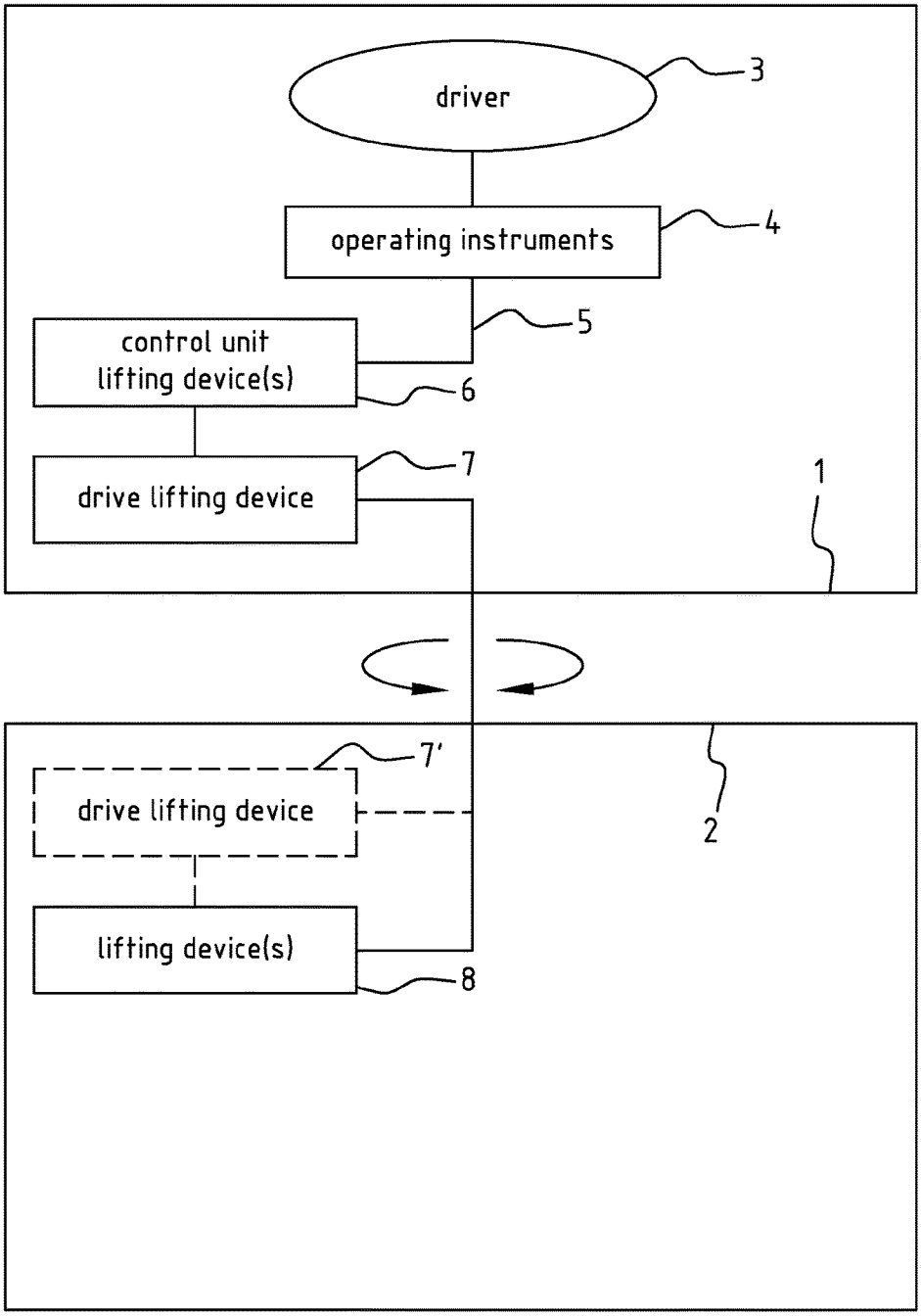
FIGS. 2-14 illustrate block diagrams of respective embodiments of a mobile apparatus according to the invention.

FIG. 2 is a schematic representation of rotatable sub-frame 1, main frame 2, the location of the driver on sub-frame 3, the operating instruments on sub-frame 4, a bus system 5 coupled to operating instruments 4, a lifting device on main frame 8, a drive 7, for instance a pump or valve block, of lifting device 8, and a control unit 6 for controlling the drive 7. A part 7' of the drive can optionally be provided in main frame 2. If the drive is a pump or valve block, hydraulic lines will run from sub-frame 1 to main frame 2.

Figure 3:
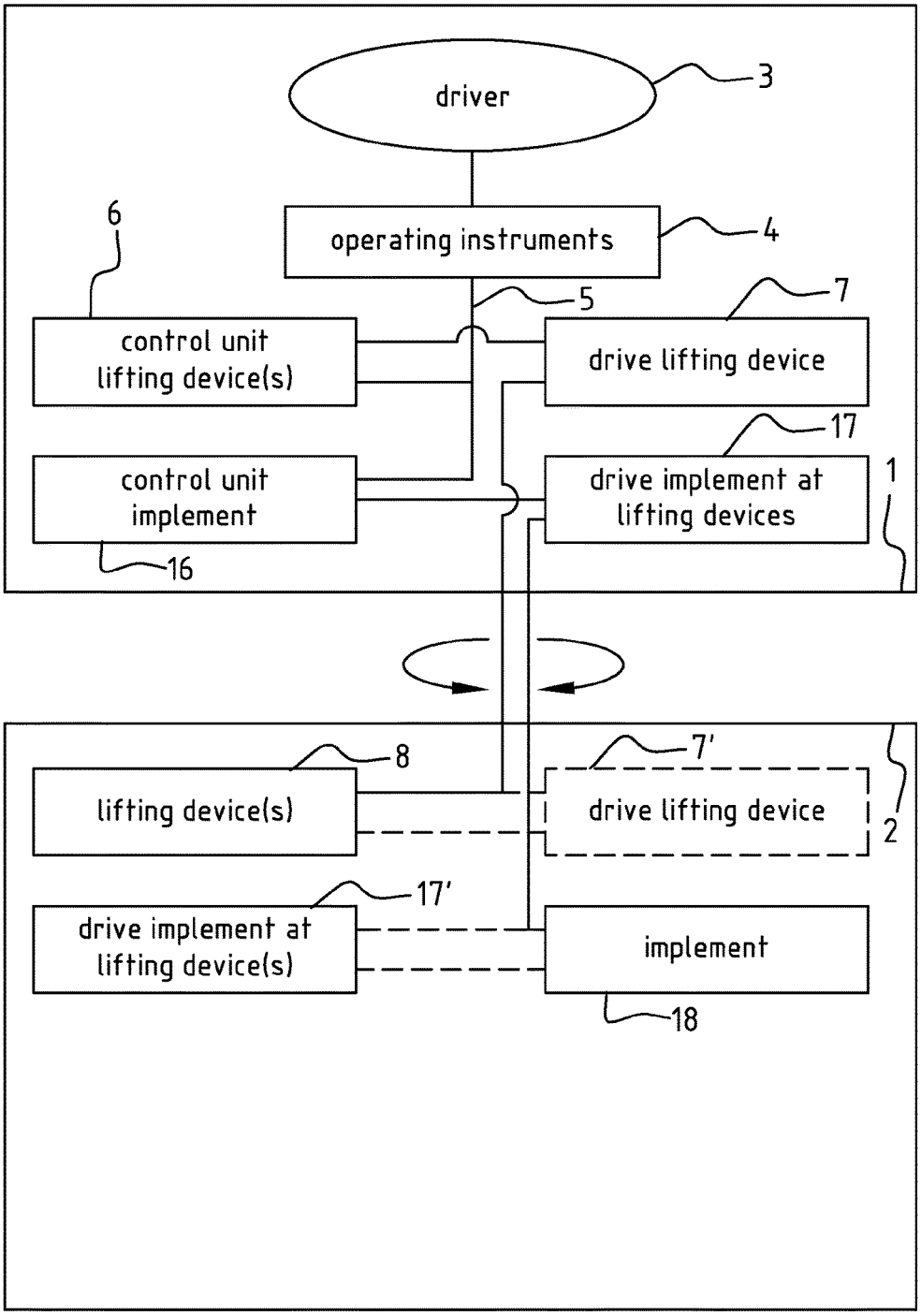

FIG. 3 shows a further embodiment in which a drive 17 for an implement 18 on lifting device 8 and a control unit 16 are also provided in the main frame in addition to the components of FIG. 2. This control unit 16 is likewise coupled to bus system 5 and configured to operate drive 17 in accordance with signals transmitted by operating instruments 4 via bus system 5.

Figure 4:
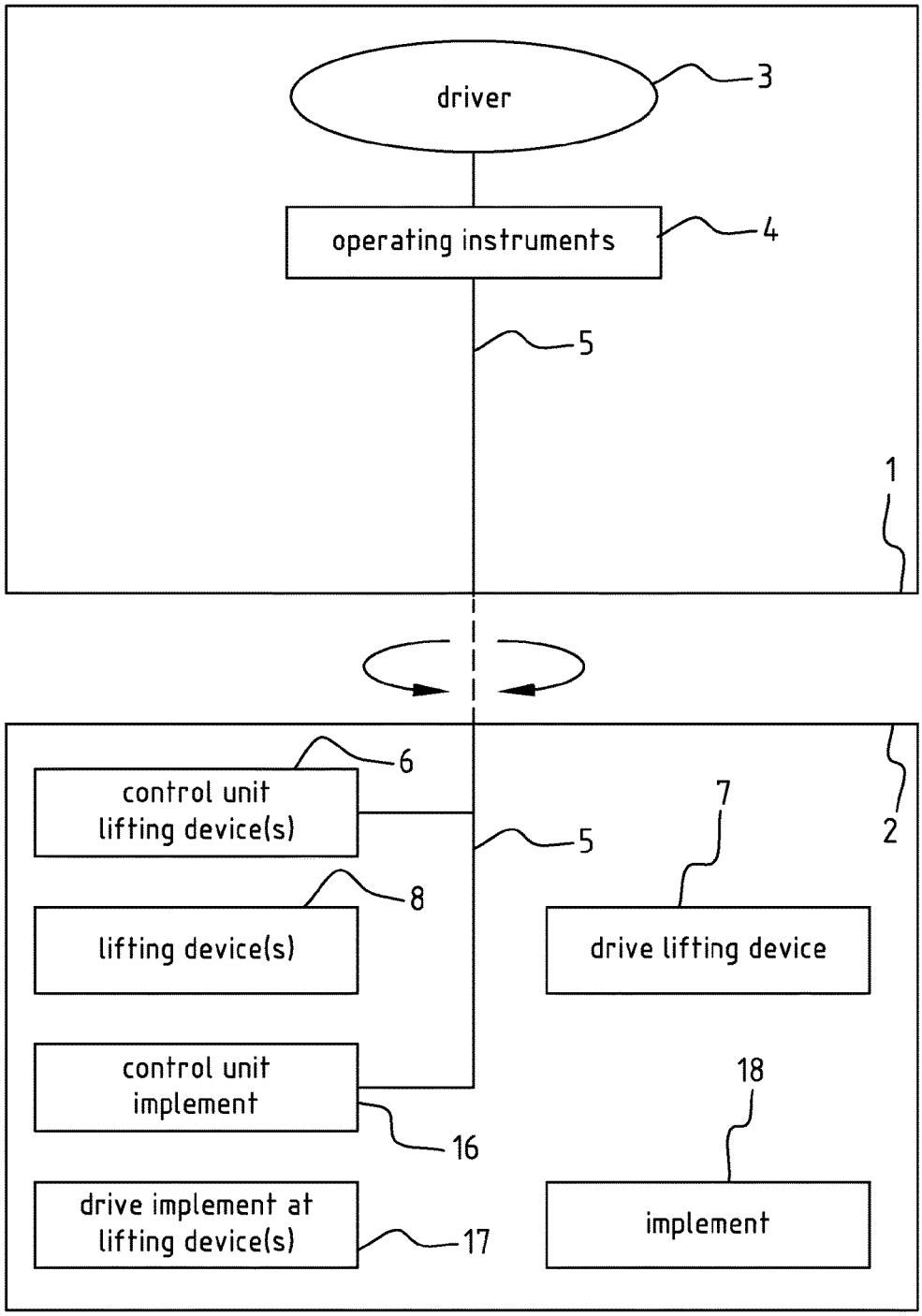

FIG. 4 illustrates that components 6, 7 and 16, 17 can also be placed on the main frame. Bus system 5 in this case extends into the main frame.

Figure 5:
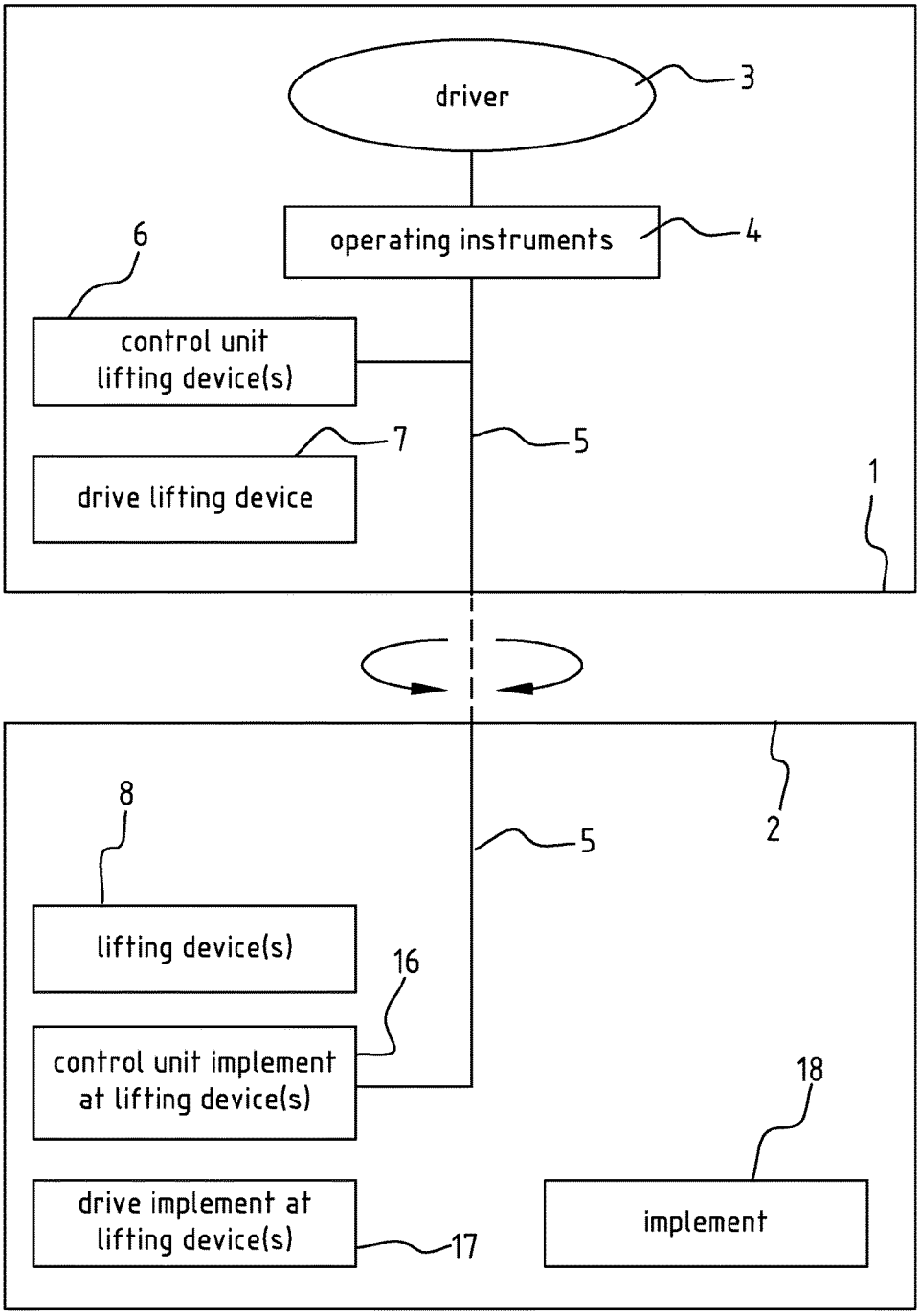

FIG. 5 illustrates that components 6, 7 can be placed on sub-frame 1, while components 16, 17 are arranged on main frame 2.

Figure 6:
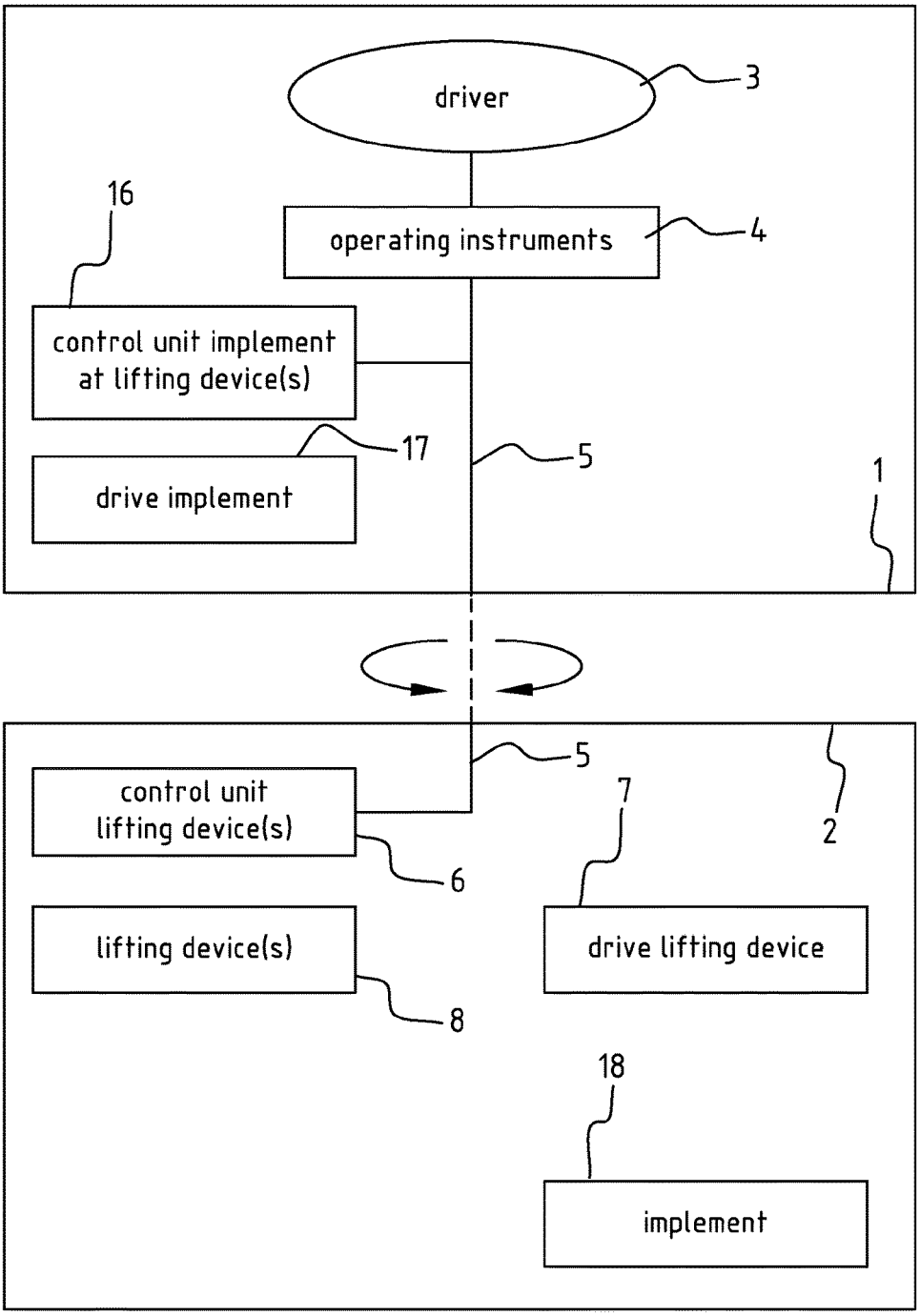

FIG. 6 illustrates that components 16, 17 can be placed on sub-frame 1, while components 6, 7 are arranged on main frame 2.

Figure 7:
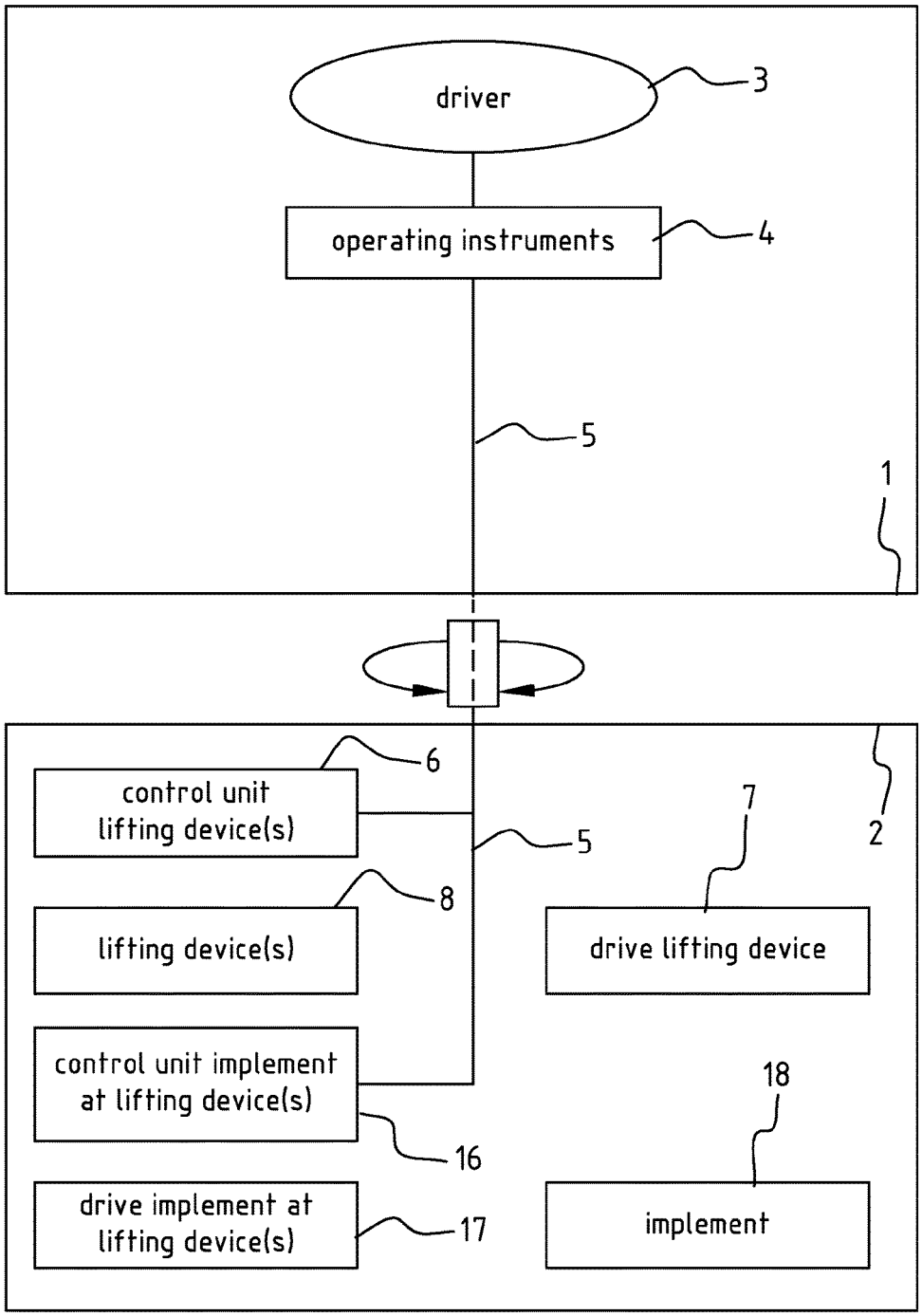

FIG. 7 illustrates an embodiment with a device 10 for transmitting bus signals from the sub-frame to the main frame and from the main frame to the sub-frame. As stated above, this can be a so-called slip ring or a receiving and transmitting unit for wireless signals. This variant is otherwise the same as the variant of FIG. 5, although the skilled person will appreciate that the mobile apparatus of FIG. 7 could also be embodied as according to the variant of FIG. 6 or 7.

Figure 8:
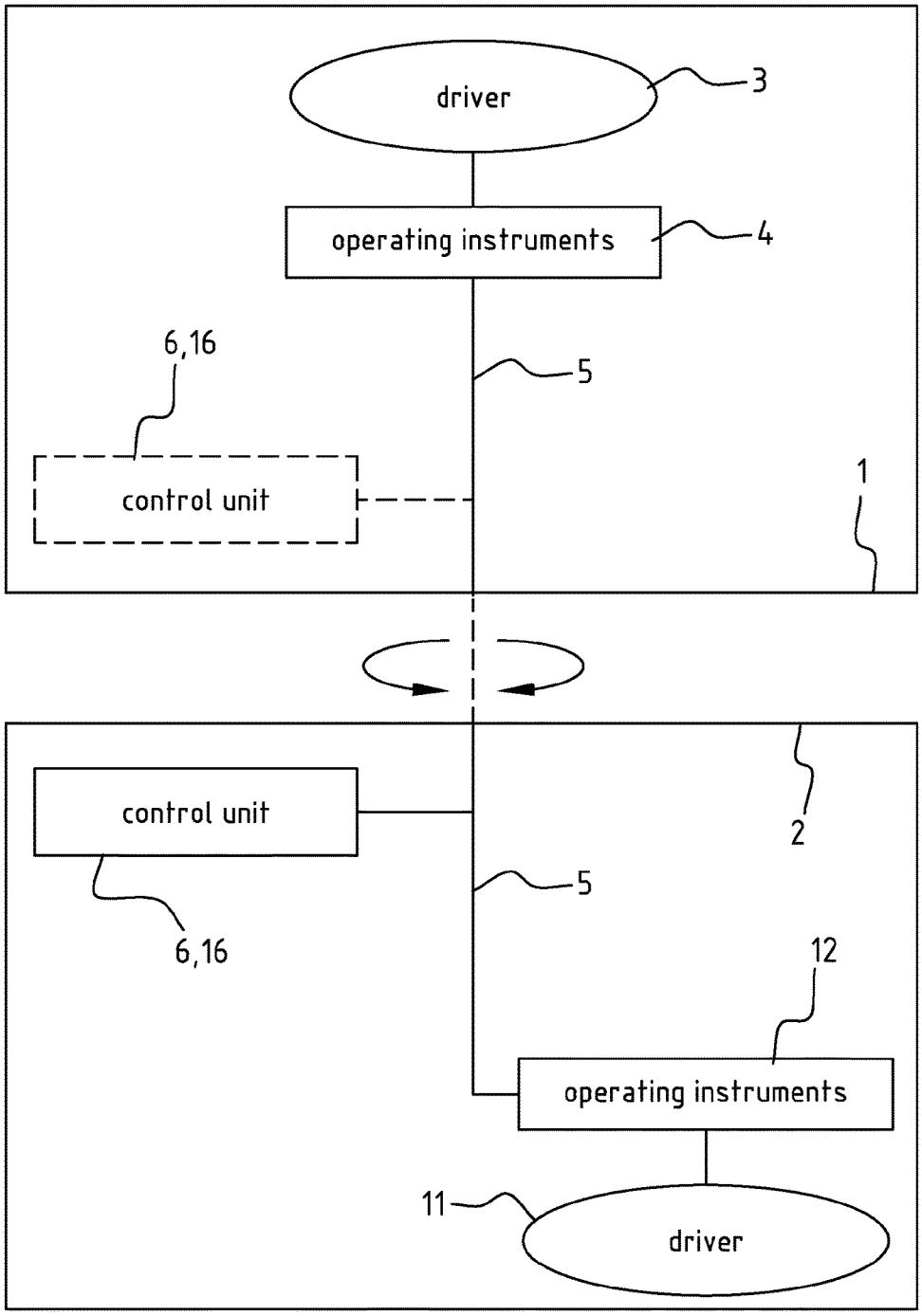

FIG. 8 illustrates an embodiment in which a driver 11 can enter signals via bus system 5 via additional operating instruments 12 on the main frame.

Figure 9:
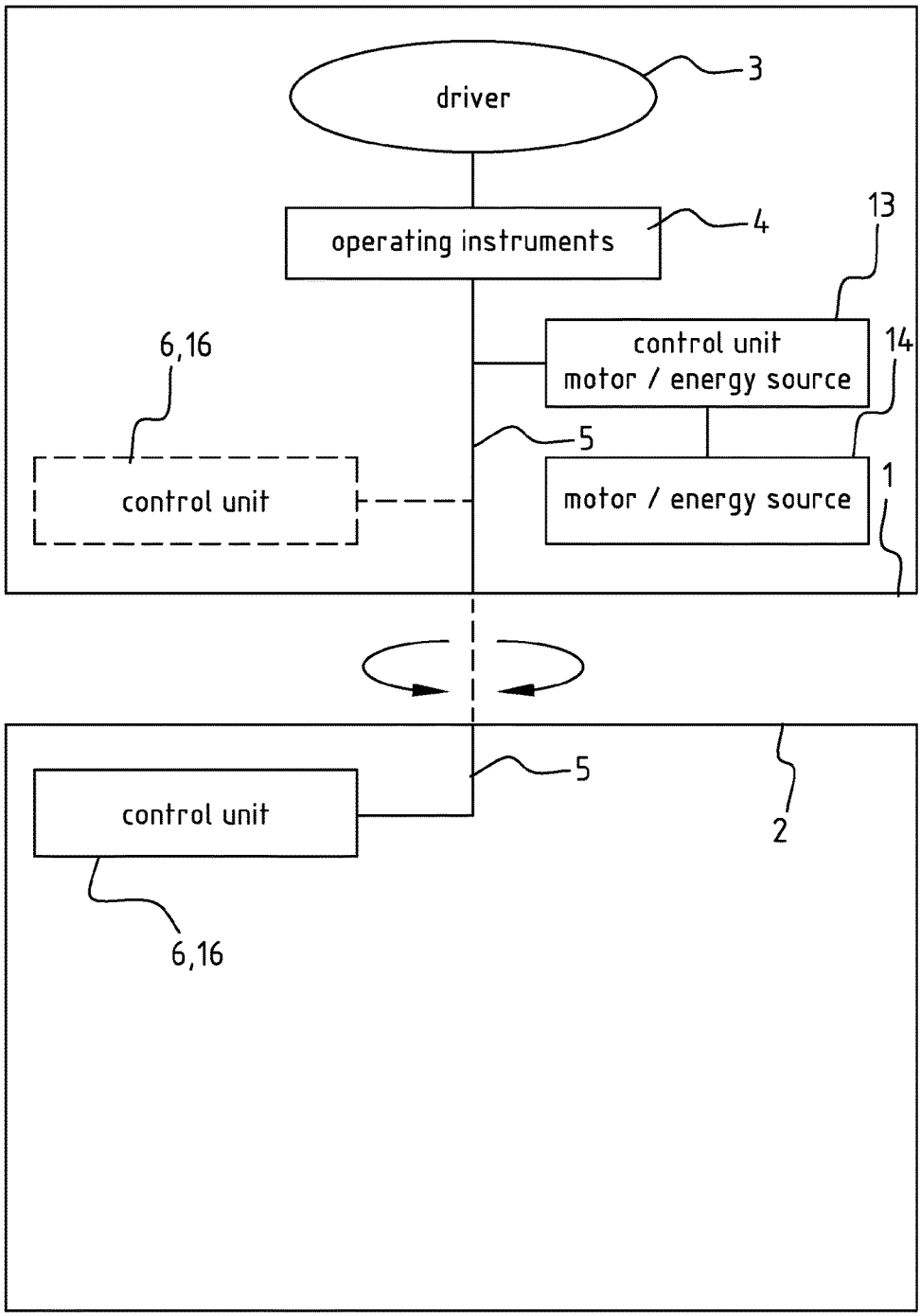

FIG. 9 illustrates an embodiment in which an energy source or motor 14 with a control unit 13 is placed on the sub-frame. Control unit 13 is coupled to bus system 5 and configured to receive signals from operating instruments 4, 12 via the bus system.

Figure 10:
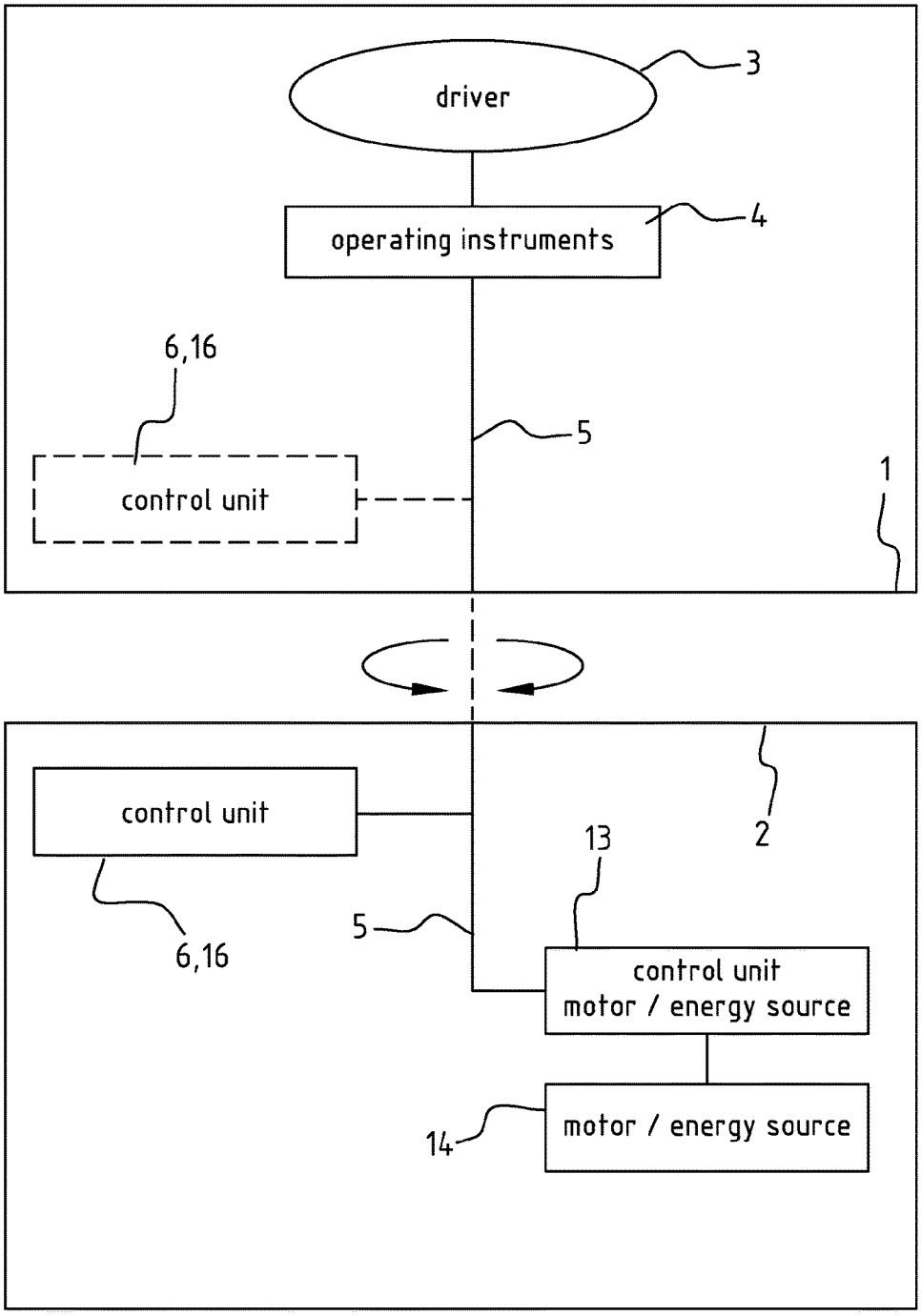

FIG. 10 illustrates an embodiment in which an energy source or motor 14 with a control unit 13 is placed on the main frame. Control unit 13 is coupled to bus system 5 and configured to receive signals from operating instruments 4, 12 via the bus system.

Figure 11:
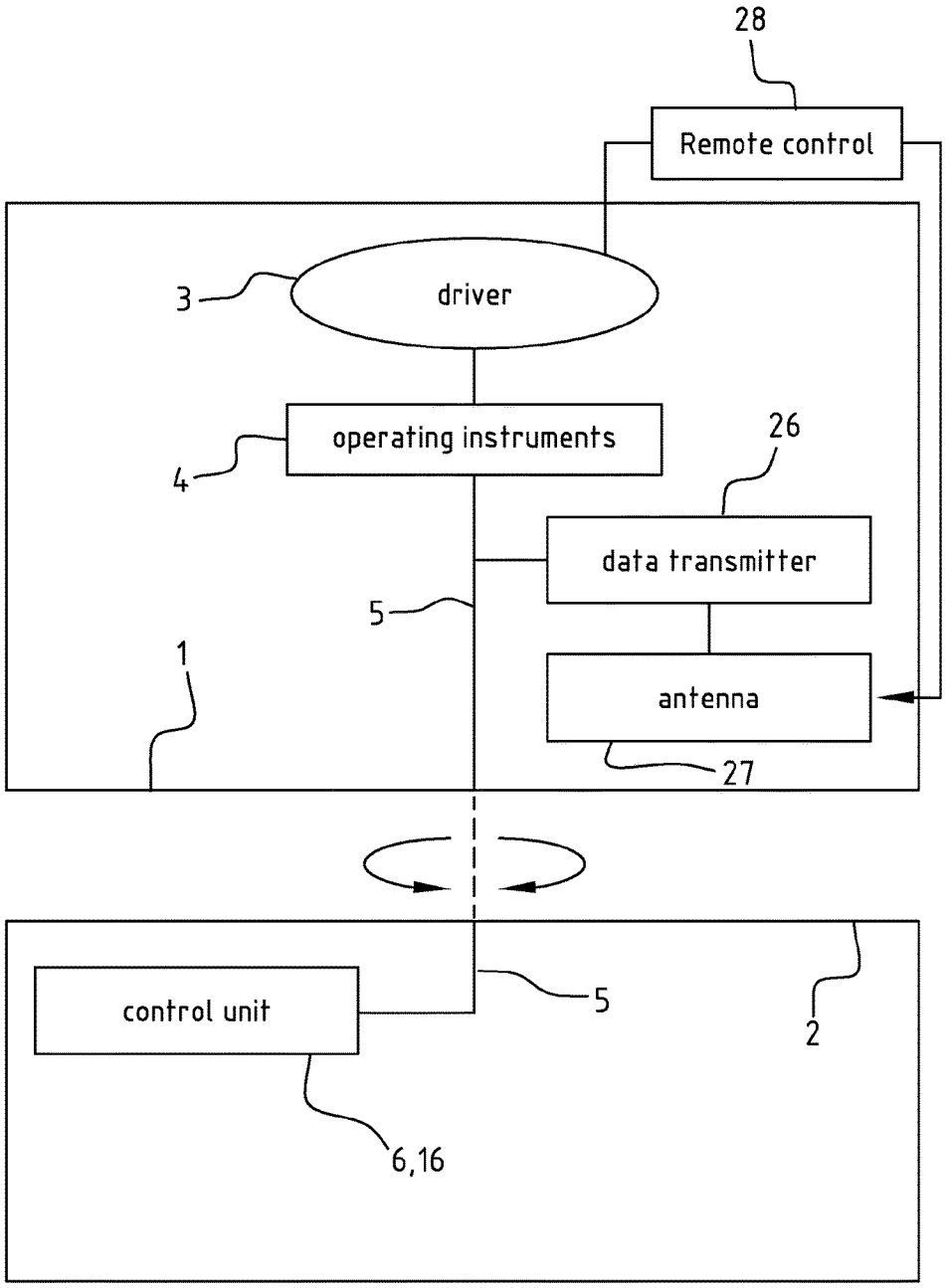

FIG. 11 illustrates an embodiment in which a data transmitter 26 is coupled on the one hand to bus system 5 and on the other to an antenna 27 for the purpose of receiving wireless commands from a remote control 28. These wireless commands are converted by data transmitter 26 into bus signals suitable for controlling control unit 6, 16.

Figure 12:
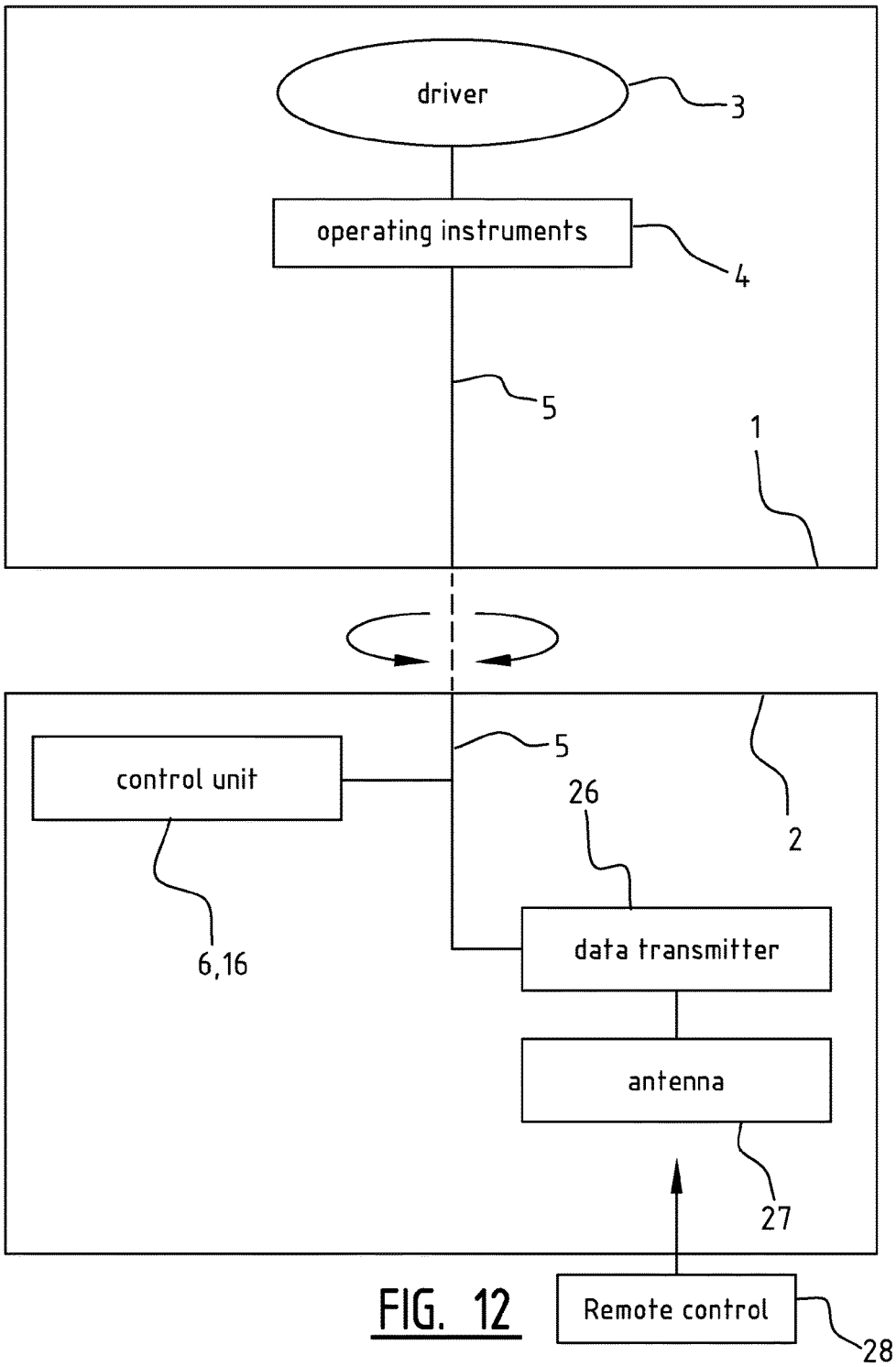

FIG. 12 illustrates an embodiment which is similar to that of FIG. 11 but wherein data transmitter 26 and antenna 27 are arranged on the main frame.

Figure 13:
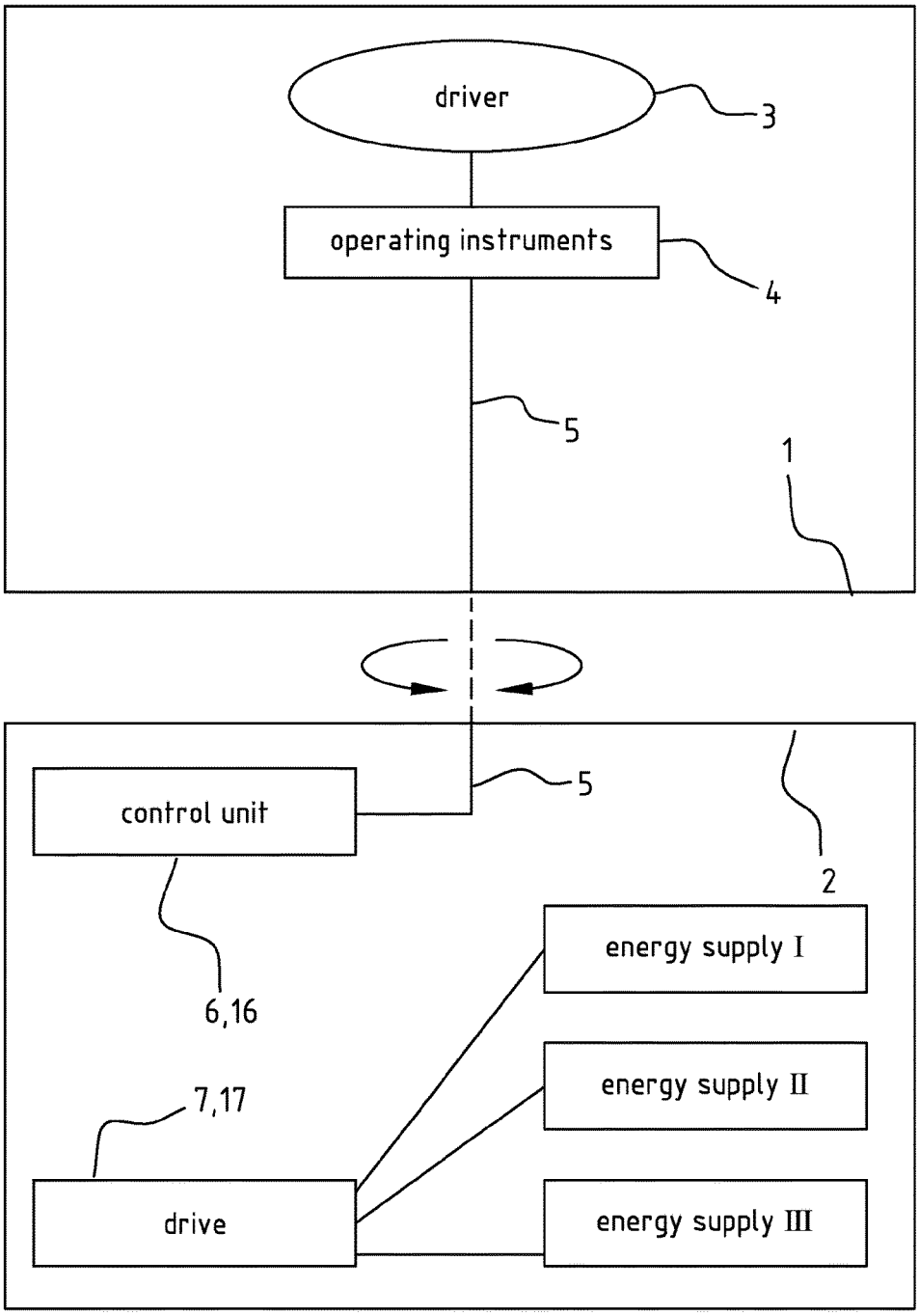

FIG. 13 illustrates an embodiment in which the energy supply (the drive) 7, 17 of the implement and/or the lifting device can distribute energy via a plurality of energy flows, such as a first flow (I), a second flow (II) and a third flow (III).

Figure 14:
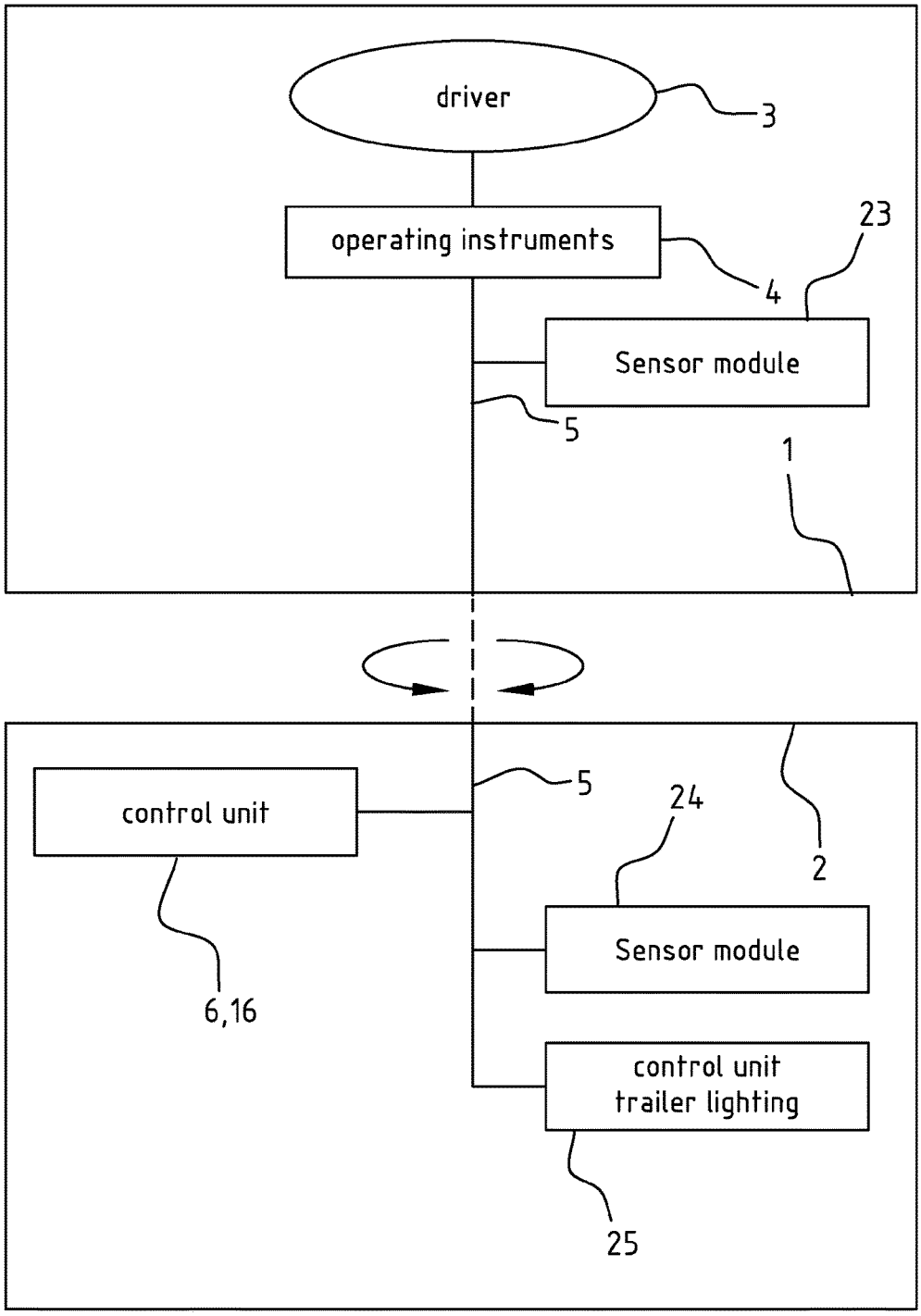

FIG. 14 illustrates an embodiment in which sensor modules 23, 24, 25 are placed on the sub-frame and on the main frame. The sensor modules are connected to the bus systems and configured to transmit signals with measurement information via the bus system to control unit 6, 16 and/or to operating instruments 4, and/or to warning means (not shown) on the sub- and/or main frame.

The invention is not limited to the above described embodiments, and the skilled person will appreciate that many modifications can be envisaged within the scope of the invention.

The invention claimed is:

1. Mobile apparatus comprising:

a main frame provided with displacing means; and a sub-frame connected rotatably to the main frame and an operating arm connected to the sub-frame, wherein the sub-frame is provided with a seating or standing location for a driver, operating instruments controllable by a driver, and a bus system connected to the operating instruments;

wherein the main frame is provided with a lifting device to which an implement is connected, wherein the lifting device comprises a lifting arm, and wherein the implement is coupled to the lifting arm;

wherein the mobile apparatus further comprises at least one drive configured for driving independently moving the lifting arm upward and downward with respect to the main frame and for operating the implement, and a control unit connected to the bus system for controlling said at least one drive on the basis of signals from the bus system such that the lifting device and the implement are independently controllable via the bus system using the operating instruments in the sub-frame such that a driver can control independently a first energy flow for moving the lifting arm upward and downward with respect to the main frame and a second energy flow for operating the implement connected to the lifting device, and wherein said at least one drive comprises at least one energy source and at least one motor.

2. Mobile apparatus as claimed in claim 1, wherein the bus system is a vehicle bus system configured to communicate by means of a Controller Area Network (CAN) protocol.

3. Mobile apparatus as claimed in claim 1, wherein the lifting device is of the three-point lifting device type.

4. Mobile apparatus as claimed in claim 1, wherein the at least one drive comprises a rotating power take-off shaft arranged for driving the implement.

5. Mobile apparatus as claimed in claim 1, wherein a slip ring configured to transfer signals from the bus system between the sub-frame and the main frame is provided between the main frame and the sub-frame.

6. Mobile apparatus as claimed in claim 1, wherein additional operating instruments for at least one of the lifting device and/or for the implement are disposed at a location on the main frame in the vicinity of the lifting device, wherein said additional operating instruments are connected to the bus system and comprises at least one of a button and a joystick.

7. Mobile apparatus as claimed in claim 1 with a front side and a rear side related to a travel direction of the mobile apparatus, wherein the lifting device is provided on the front side or on the rear side of the main frame, wherein the control unit comprises at least one of a controller, an I/O unit, or an ECU;

wherein the implement coupled to the lifting arm extends in front of the front side or behind the rear side.

8. Mobile apparatus as claimed in claim 7, wherein the at least one drive is configured to adjust an angle of the implement using the second energy flow.

9. Mobile apparatus as claimed in claim 1, wherein the lifting device is provided with a quick change system to which the implement is connectable.

10. Mobile apparatus as claimed in claim 9, further comprising positioning means configured to adjust an angle of the quick change system, and wherein a quick change control unit connected to the bus system is provided which is configured to control the positioning means on the basis of signals from the bus system.

11. Mobile apparatus as claimed in claim 9, comprising:

at least one sensor module configured to measure the movements and/or the functioning of the quick change system, which at least one sensor module is coupled to at least one of the bus system and the control unit; and a warning means coupled to the bus system, the warning means being configured to warn a driver on the basis of signals measured by the at least one sensor module.

12. Mobile apparatus as claimed in claim 1, comprising at least one sensor module configured to measure the movements and/or the functioning of the lifting device and implement, which at least one sensor module is coupled to at least one of the bus system and the control unit.

13. Mobile apparatus as claimed in claim 12, wherein the control unit is configured to receive signals with measurement values from the at least one sensor module and to control the at least one drive of the lifting device and the implement partially on the basis of said signal with measurement values.

14. Mobile apparatus as claimed in claim 1, wherein the at least one drive comprises a first line for generating the first energy flow as a hydraulic or pneumatic or electrical flow to the lifting device, and a rotating shaft for generating the second energy flow for the implement.

15. Mobile apparatus as claimed in claim 1, wherein the at least one of an energy source or motor is also arranged for displacing the mobile apparatus on the displacing means.

16. Mobile apparatus as claimed in claim 1, wherein the bus system runs from the sub-frame to the main frame.

17. Mobile apparatus as claimed in claim 1, wherein the sub-frame is provided with a transmitting/receiving device for wireless transfer between the sub-frame and the main frame.

18. Mobile apparatus comprising:

a main frame;

a sub-frame connected rotatably to the main frame and an operating arm connected to the sub-frame; and a bus system, wherein the main frame is provided with a lifting device to which an implement is connected, wherein the lifting device comprises a lifting arm, and wherein the implement is coupled to the lifting arm;

wherein the mobile apparatus further comprises at least one drive for generating a first energy flow for moving the lifting device upward and downward with respect to the main frame, and a second energy flow for operating the implement, and said mobile apparatus further comprising a receiving module connected to the bus system and having an antenna configured to receive wireless signals and to convert said signals to bus signals, wherein the receiving module is configured such that the lifting device and the implement can be operated wirelessly using a remote control, and such that said bus signals control the first energy flow for moving the lifting arm upward and downward with respect to the main frame and the secondary energy flow for operating the implement independently, wherein said at least one drive comprises at least one of an energy source and a motor.

* * * * *